US005222340A

United States Patent [19]

Bellem

[11] Patent Number: 5,222,340

[45] Date of Patent: Jun. 29, 1993

[54] INCREASING UPLIFT RESISTANCE OF METAL STANDING SEAM ROOF

[75] Inventor: Norman A. Bellem, Lee's Summit, Mo.

[73] Assignee: Butler Manufacturing Company, Grandview, Mo.

[21] Appl. No.: 877,973

[22] Filed: May 4, 1992

[51] Int. Cl.[5] ..... E04C 3/00

[52] U.S. Cl. ..... 52/463; 52/478; 403/380; 403/388

[58] Field of Search ..... 52/463, 478, 543, 545, 52/547, 537, 520, 462; 403/380, 388, 408.1

[56] References Cited

U.S. PATENT DOCUMENTS

| | | | |
|---|---|---|---|
| 211,973 | 2/1879 | Dalzell . | |
| 1,598,962 | 9/1926 | Fisch . | |
| 1,693,274 | 11/1928 | Hayman . | |
| 2,335,383 | 11/1943 | Bonsall . | |
| 2,543,550 | 2/1951 | Kneeland . | |
| 2,638,063 | 5/1951 | Clark . | |
| 2,907,287 | 10/1959 | Trostle | 52/463 |
| 3,055,147 | 9/1962 | Goodwin | 52/463 |
| 3,165,341 | 1/1965 | Burns et al. . | |
| 3,327,443 | 6/1967 | Gay | 52/463 |
| 3,376,680 | 5/1968 | Gyekis | 52/463 |
| 3,394,508 | 7/1968 | Burke | 52/463 |
| 3,970,402 | 7/1976 | Yamashita . | |
| 4,168,596 | 9/1979 | Yoder, Jr. . | |
| 4,271,651 | 6/1981 | Sorrells, Jr. . | |
| 4,361,998 | 12/1982 | Ellison et al. . | |
| 4,366,656 | 1/1983 | Simpson . | |
| 4,422,278 | 12/1983 | Fujihiro et al. . | |
| 4,467,582 | 8/1984 | Hague . | |
| 4,649,684 | 3/1987 | Petree et al. . | |
| 4,871,278 | 10/1989 | Gerlach et al. . | |

*Primary Examiner*—Richard E. Chilcot, Jr.
*Assistant Examiner*—Beth A. Aubrey
*Attorney, Agent, or Firm*—Shoemaker and Mattare Ltd.

[57] ABSTRACT

A seamed metal roof is formed from an array of panels having lateral edges interconnected by rolled seams, and a plurality of clamps, each comprising a first elongate part having a mating surface, a longitudinal recess having dimensions like those of the seam, a second elongate part having a mating surface opposing the recess and the mating surface of the first part, and a fastener for drawing said parts together, to confine the seam in the recess.

8 Claims, 3 Drawing Sheets

INCREASING UPLIFT RESISTANCE OF METAL STANDING SEAM ROOF

BACKGROUND OF THE INVENTION

This invention relates to building construction generally, and more particularly to a method and device for reinforcing metal roofs against wind lift.

As wind blows over a roof, the roof panels are subject to static air pressure from below, and a reduced or negative pressure above, according to Bernoulli's principle. Additionally, wind tends to "climb" the windward wall of a building, so that the leading edge of the roof on the windward side may actually have a positive angle of attack with respect to the wind, which increases the lifting force, particularly at the very edge and leading corners of the roof. The forces developed by high winds can be very large, and, depending on the height, orientation, roof slope, and other factors, these forces may be sufficient to cause seams and panel fasteners to fail. Once this happens, an entire portion of a roof can tear away, with potential disastrous results for the occupants or contents of the building. If the roof clips release, allowing the roof panels to break free completely, there is an additional hazard to people and objects downwind of the building. Therefore, we are concerned with strengthening roof panel seams and attachments, to prevent such failures.

We have determined that metal standing seam roofs fail, in many cases, during the uplift mode, due to concentrated loads developed at the location of clips which attach the roof panels to substructure. Such loads cause local distortion and buckling of some panels long before the panel itself fails in bending or other roof components fail. Our approach to solving this problem is to reinforce the panel-to-panel seams, and the points of load transfer to the structure, and thus prevent seam distortion, panel buckling, and seam failure. To do so, we have developed a seam clamp that maintains seam and corrugation geometry during uplift loading.

SUMMARY OF THE INVENTION

An object of the invention is to strengthen a standing seam between metal roof panels, to provide improved resistance to wind damage, without significantly increasing costs.

Another object of the invention is to strengthen a metal roof, without requiring an increase in gauge of the roof, or any modification of its seam structure.

A further object of the invention is to provide for simple manufacture and installation of roof strengthening components.

One other object is to avoid detracting from the appearance of a metal panel roof while reinforcing it.

These and other objects are attained by a seamed metal roof formed from an array of panels having lateral edges interconnected by rolled seams, and a plurality of seam clamps placed at high-stress points on the roof. Each clamp comprises a first elongate part having a mating surface, a longitudinal recess having dimensions like those of the seam, a second elongate part having a mating surface opposing the recess and the mating surface of the first part, and a fastener for drawing said parts together, to confine the seam in the recess.

BRIEF DESCRIPTION OF THE DRAWINGS

In the accompanying drawings,

FIG. 1 shows a typical standard metal building in a windy situation, wind flow being indicated at various points by arrows. It can be seen that the roof panels P are subject to lifting forces F resulting both from airfoil effects, and by dynamic pressure forces developed at the roof edge where there is a positive angle of attack $\alpha$.

DESCRIPTION OF THE PREFERRED EMBODIMENT

FIGS. 2–5 illustrates a roof formed from an array of separate roof panels P, interconnected along their lateral edges by standing seams S, which are formed in situ by automatic machinery. The longitudinal ends of the panels simply overlap, and are usually sealed, depending on the environment and purpose of the roof.

Figure 1:
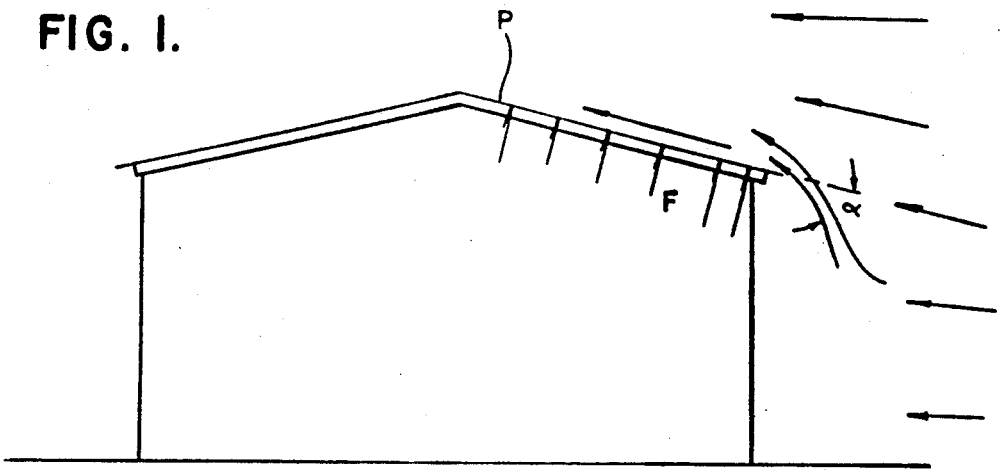
FIG. 1 is a side elevation of a building having a metal panel roof, showing wind flow over the roof.
Figure 5:
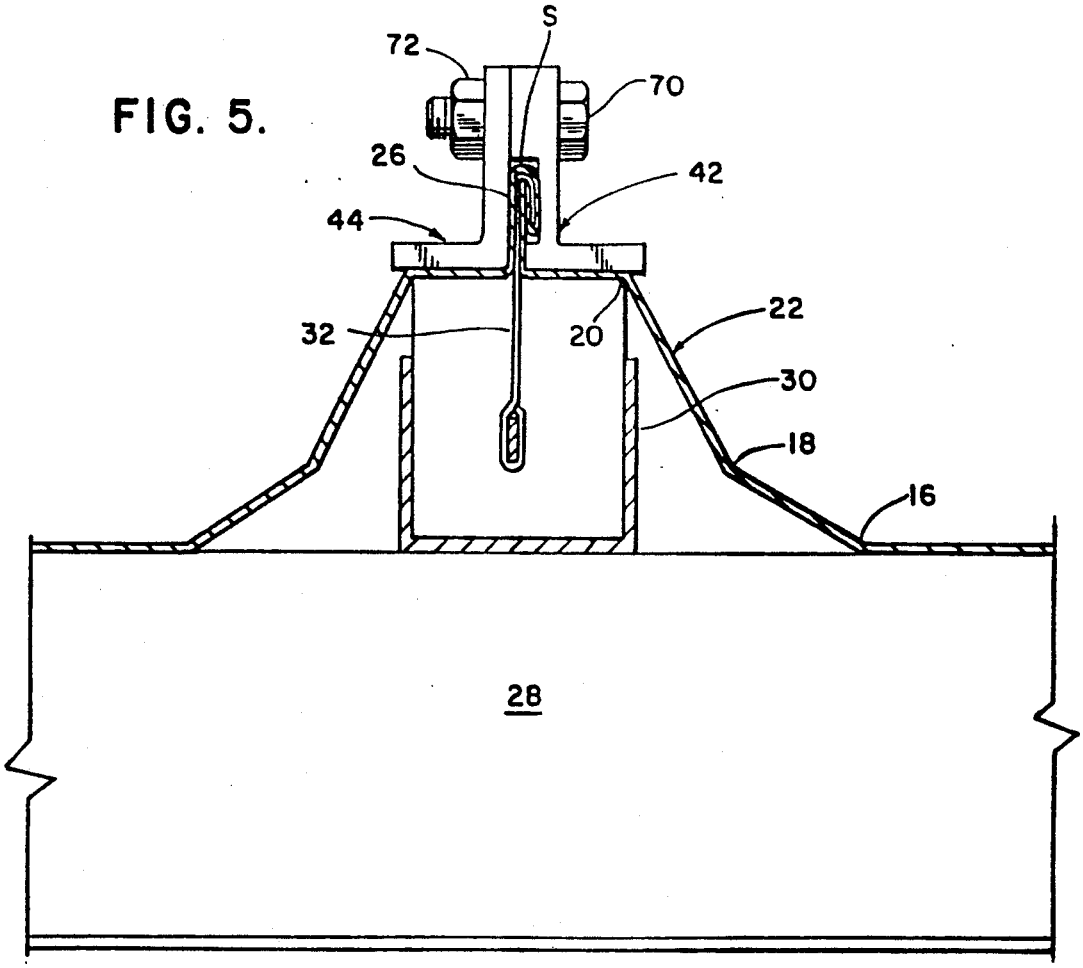
FIG. 5 is a cross-sectional view of a portion of the roof, taken in the direction of arrows 5—5 in FIG. 2.
Figures 2, 3, 4:
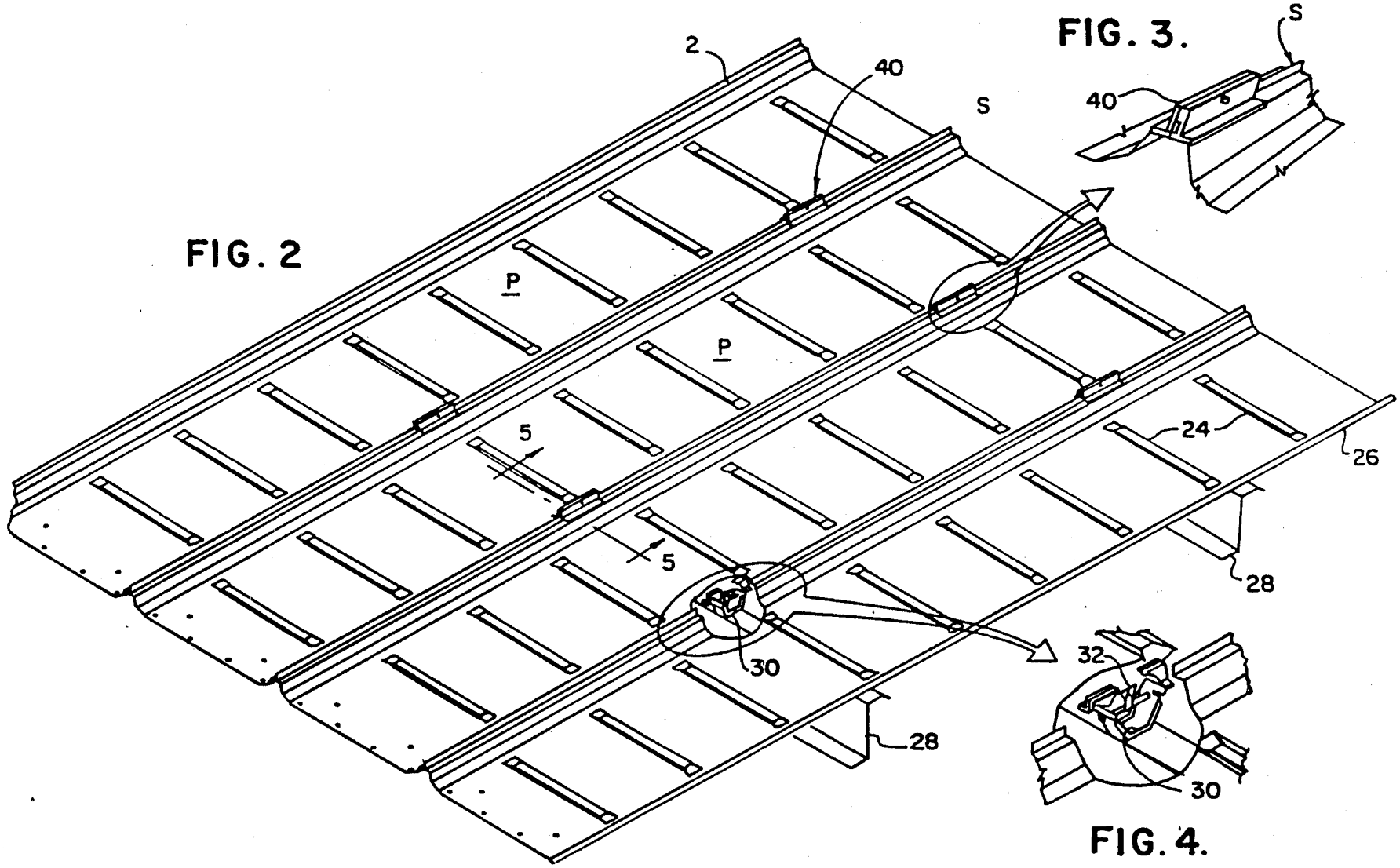
FIG. 2 is an isometric view of a portion of the building roof, taken from above the building.
FIG. 3 is a detailed view of a portion of FIG. 2, at an enlarged scale.
FIG. 4 is a detailed view of another portion of FIG. 2, also at an enlarged scale.

As best seen in FIG. 5, the lateral edges 12, 14 of each panel are bent along lines 16, 18, and 20, so that when joined, they form a corrugation 22 giving the roof resistance against bending along the direction of the seams. Note also the series of transverse embossments 24 (FIG. 2), which provide bending resistance in the transverse direction. A flange 26 is formed along each lateral edge of each panel, and two apposed flanges of neighboring panels are rolled together to form a rolled seam S. Tabs or straps 32 extending from attachment clips 30, previously installed at intervals on or in a purlins, bar joists or like substructure 28, are rolled into the seam, thus securing the panels to the sub-structure. One may refer to U.S. Pat. No. 4,543,760, which is incorporated herein by reference, for details of the attachment clip.

The foregoing structure is conventional, and has been relied on for years. Under very high wind loading, even rolled seams may fail. Failure tends to occur where concentrated loads are applied, that is, at the points where the attachment clips meet the seams, and particularly in areas of highest wind loading, near the leading edges and corners of the roof. We have determined that the strength of the roof can be dramatically increased by reinforcing the seams by externally clamping them at these potential failure points. The clamp shown in detail in FIGS. 5 and 6 provides the necessary reinforcement, without requiring any alteration of conventional roof construction.

Figure 6:
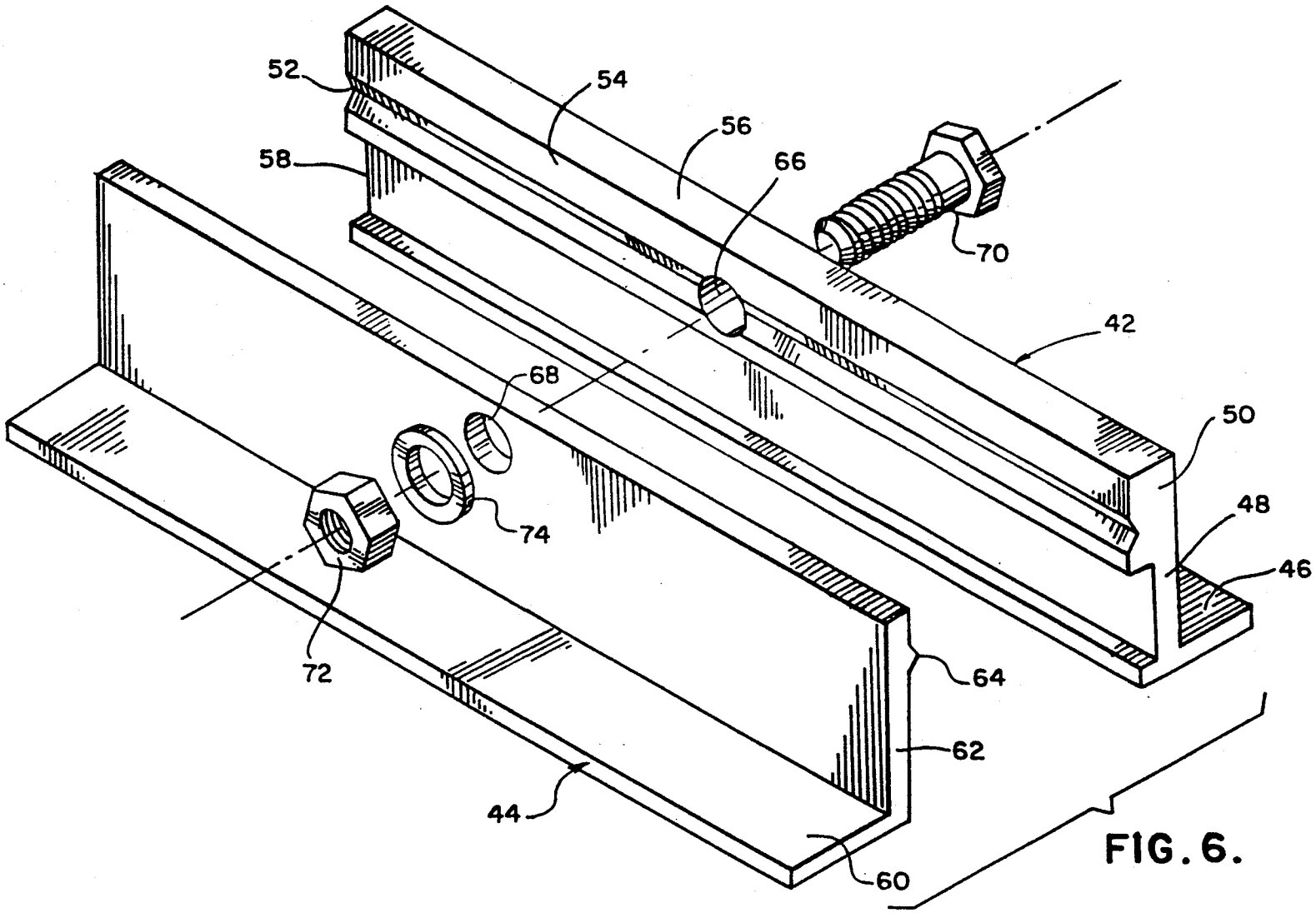
FIG. 6 is an exploded isometric view of the seam reinforcing clamp shown in FIGS. 2, 3 and 5.

Referring to FIG. 6, a seam reinforcing clamp 40 embodying the invention comprises two metal parts 42 and 44, which can easily be produced by extrusion. For convenience, we refer to the part 42 as "female" and the part 44 as "male". The geometry of the clamp is determined by that of the seam (including the clip strap rolled into it), which has a height H and a rolled width W. The female part 42 of the clamp has a foot 46 approximately ¾ inch wide (extending slightly beyond the top surface of the corrugation, to prevent deformation of the corrugation) at the bottom of a vertically extending body 48. An enlarged head 50 has a longitudinal V-groove 52 running along its inner face 54 approximately midway between the top surface 56 of the head and a recess 58 defining the bottom of the head. The height and width of the recess are chosen so just as to accept the rolled seam in either direction. By closely confining the seam at stress points, we have found that seam failure is better prevented.

The inner face 54 of the head 50 forms a mating plane with the opposite part, and it will be observed that the foot 46 is offset from this plane by a distance at most equal to twice the gauge of the panel metal, plus the thickness of a clip strap 30, so the flanges are kept in face-to-face abutment, preventing any tendency to open the seam. Note that the bottom inner edges of each of the parts 42 and 44 is radiused to preserve minimum bend radius of the panel material, and to keep from cutting into the panel surface.

The male part 44 has, like the female part, a foot 60 at the bottom of a leg 62; unlike the body 48, however, the leg 62 is of uniform thickness, except for a longitudinally extending V-rib 64 at the same level as the V-groove 52. Each of the parts has a bolt hole 66, 68 near its lengthwise mid-point; the centerline of the hole approximately passes through the apex of the V-shaped groove and rib. A bolt 70 is passed through the holes, and secured with a nut 72 and lockwasher 74. If desired, more than one bolt, or a different type of fastener could be used to hold the male and female parts together; this would be considered within the skill of the artisan. Regardless, when the parts are thus assembled, the rib and groove fit together, and the bottom surfaces of the feet are coplanar, standing on the top of the corrugation.

As mentioned, the clamp should be installed on roof seams at their most highly stressed points, that is, over attachment clips near the roof edges and corners. In preliminary testing of the invention, an approximate doubling of blow-off loads has been observed with 24-gauge metal roofing.

Since the invention is subject to modifications and variations, it is intended that the foregoing description and the accompanying drawings shall be interpreted as illustrative of only one form of the invention, whose scope is to be measured by the following claims.

I claim:

1. A clamp for reinforcing a rolled seam, of predetermined height and width, formed between apposed flanges of adjacent metal roof panels of a predetermined gauge, said clamp comprising a first elongate part having a head with a mating surface, a longitudinal recess beneath said head having a depth equal to the width of the seam, and a height equal to the height of the seam, and a foot extending below the recess and bounded by a plane offset from that of said mating surface by a distance equal to twice said predetermined gauge, and a second elongate part having a mating surface opposing said recess and the mating surface of said first part, and at least one fastener for drawing said parts together, to confine said seam in said recess and clamp said flanges together, face-to-face.

2. The invention of claim 1, wherein each of said parts has a hole extending laterally through, above said seam, and said fastener is a nut and bolt in combination.

3. The invention of claim 1, wherein one of said parts has a groove in its mating face, said groove extending lengthwise parallel to said seam at a predetermined height above the seam, and the other of said parts has a rib on its mating face, said rib having a cross-section complementary to that of said groove, and extending at a like height above said seam, whereby the rib and groove interfit when the parts are assembled, and keep them in alignment.

4. The invention of claim 3, wherein each of said parts has a hole extending laterally through, above said seam, and said fastener is a nut and bolt in combination.

5. The invention of claim 4, wherein said holes have center-lines passing through said groove and said rib.

6. The invention of claim 1, wherein each of said parts has a foot formed by horizontal flange extending away from its mating surface, for engaging a horizontal portion of a respective one of said roof panels, and for reinforcing the part against bending.

7. A method of reinforcing a roof, formed of panels laterally interconnected by rolled seams and secured to substructure at intervals by attachment clips joined to the seams, against wind uplift loading, comprising steps of identifying areas of maximum wind loading and applying a plurality of clamps to said seams, above said attachment clips, in each of said areas; each of said clamps comprising a first elongate part having a mating surface and a second elongate part having a mating surface opposing said mating surface of said first elongate part.

8. A seamed metal roof comprising an array of panels having lateral edges, neighboring panels being connected together along their lateral edges by rolled seams, and a plurality of seam clamps, each comprising a first elongate part having a mating surface, a longitudinal recess having dimensions like those of the seam, a second elongate part having a mating surface opposing said recess and the mating surface of said first part, and a fastener for drawing said parts together, to confine said seam in said recess.

* * * * *